US007797955B2

(12) United States Patent
Ohta

(10) Patent No.: US 7,797,955 B2
(45) Date of Patent: Sep. 21, 2010

(54) SUPERCRITICAL CYCLE AND EXPANSION VALVE USED FOR REFRIGERATION CYCLE

(75) Inventor: Hiromi Ohta, Okazaki (JP)

(73) Assignee: Denso Corporation, Kariya (JP)

( * ) Notice: Subject to any disclaimer, the term of this patent is extended or adjusted under 35 U.S.C. 154(b) by 728 days.

(21) Appl. No.: 11/729,543

(22) Filed: Mar. 29, 2007

(65) Prior Publication Data

US 2007/0227165 A1 Oct. 4, 2007

(30) Foreign Application Priority Data

Mar. 31, 2006 (JP) ..... 2006-099145

(51) Int. Cl.
*F25B 40/00* (2006.01)

(52) U.S. Cl. ..... 62/196.4; 62/196.1; 62/197; 62/222

(58) Field of Classification Search ..... 62/196.1, 62/196.4, 222, 527, 197
See application file for complete search history.

(56) References Cited

U.S. PATENT DOCUMENTS

| | | | | |
|---|---|---|---|---|
| 5,890,370 | A | 4/1999 | Sakakibara et al. | |
| 6,105,386 | A * | 8/2000 | Kuroda et al. | 62/513 |
| 6,189,326 | B1 | 2/2001 | Tomatsu et al. | |
| 6,540,149 | B1 | 4/2003 | Yano et al. | |
| 2006/0107673 | A1* | 5/2006 | Hirota | 62/222 |
| 2006/0150650 | A1 | 7/2006 | Murase et al. | |
| 2006/0191280 | A1* | 8/2006 | Kurosawa | 62/324.1 |
| 2007/0209387 | A1* | 9/2007 | Hirota | 62/527 |

FOREIGN PATENT DOCUMENTS

| | | |
|---|---|---|
| CN | 1281111 | 1/2001 |
| JP | 9-264622 | 10/1997 |
| JP | 11-201568 | 7/1999 |
| JP | 2000-081157 | 3/2000 |
| JP | 2001-153499 | 6/2001 |
| JP | 2003-130481 | 5/2003 |
| JP | 2003-343946 | 12/2003 |
| JP | 2006-220407 | 8/2006 |
| WO | WO 97/34116 | 9/1997 |
| WO | WO 01/01053 | 1/2001 |

* cited by examiner

*Primary Examiner*—Cheryl J Tyler
*Assistant Examiner*—Jonathan Bradford
(74) *Attorney, Agent, or Firm*—Harness, Dickey & Pierce, PLC

(57) ABSTRACT

A supercritical cycle comprises an evaporator, a compressor, a gas cooler and a main valve portion of an expansion valve arranged in that order. An internal heat exchanger is arranged for exchanging heat between the high-pressure side refrigerant flowing toward the main valve portion of the expansion valve from the gas cooler and the low-pressure side refrigerant flowing toward the compressor from the evaporator. The expansion valve is formed integrally with a temperature sensing portion for controlling the main valve portion, and includes a bypass for supplying the refrigerant to the temperature sensing portion from the upstream side of the internal heat exchanger in which the high-pressure side refrigerant flows and an orifice for supplying the refrigerant from the temperature sensing portion to the refrigerant circuit downstream of the main valve portion.

16 Claims, 11 Drawing Sheets

SUPERCRITICAL CYCLE AND EXPANSION VALVE USED FOR REFRIGERATION CYCLE

BACKGROUND OF THE INVENTION

1. Field of the Invention

This invention relates to a supercritical cycle, constituting a refrigeration cycle, using a refrigerant such as $CO_2$ which, at high pressure, assumes a supercritical state. The invention also relates to an expansion valve used for the refrigeration cycle.

2. Description of the Related Art

In the conventional supercritical cycle, the opening degree of the expansion valve must be controlled to maximize the COP of the cycle with respect to the refrigerant temperature after the gas cooler. Such an expansion valve is described in Japanese Unexamined Patent Publication No. 2000-81157.

A known supercritical cycle including this expansion valve is shown in FIG. 11. The supercritical cycle 11 includes a compressor 13, a gas cooler 15, a temperature sensing portion 19 of an expansion valve 17, a main valve portion 21 of the expansion valve 17, an evaporator 23, an accumulator 25 and the compressor 13 arranged in that order so that the refrigerant is circulated in the same order. Also, an internal heat exchanger 27 is arranged in the refrigerant path between the accumulator 25 and the compressor 13 and in the refrigerant path between the temperature sensing portion 19 of the expansion valve 17 and the main valve portion 21. The heat is moved from the high-pressure refrigerant downstream of the gas cooler 15 to the low-pressure refrigerant downstream of the accumulator 25 and, thus, the enthalpy of the refrigerant at the inlet of the evaporator 23 is reduced thereby to improve the refrigeration capacity of the $CO_2$ cycle.

In this supercritical cycle 11, the refrigerant temperature at the outlet of the gas cooler 15 is detected by the temperature sensing portion 19 and, therefore, the refrigerant at the outlet of the gas cooler 15, after being supplied to the temperature sensing portion 19 of the expansion valve 17, is required to be returned to the inlet of the main valve portion 21 of the expansion valve 17 again through the internal heat exchanger 27. Although the gas cooler 15, the expansion valve 17 and the evaporator 23 can be continuously coupled, the internal heat exchanger 27 is arranged in U turn in which the refrigerant flows from the temperature sensing portion 19 and returns to the main valve portion 21 through the internal heat exchanger 27. As a result, a large space is required around the expansion valve 17, thereby posing the problem that the expansion valve cannot be easily arranged in a small engine compartment.

Also, the internal heat exchanger 27 is arranged in U turn with respect to the expansion valve 17 and cannot be arranged between the devices, thereby requiring extra piping. Especially, the internal heat exchanger 27 in a double-pipe structure, which could be used as a part of the piping system if arranged between the devices, cannot be effectively used in the U-turn arrangement.

Further, in view of the fact that the inlet and the outlet of the internal heat exchanger 27 are connected to the expansion valve 17, four joints are required for connection to the expansion valve 17. A problem results in that not only the cost is increased but also the expansion valve becomes bulky.

Furthermore, the expansion valve is controlled in such a manner that the temperature of the inflowing refrigerant is detected by the $CO_2$ gas sealed in the temperature sensing portion therein and the high pressure is controlled to a maximum COP. The $CO_2$ gas has a low critical temperature of 31° C. and, in the case where the atmospheric temperature is high, therefore, the $CO_2$ gas sealed in the temperature sensing portion assumes a supercritical state.

With the increase in the refrigerant temperature at the outlet of the gas cooler, i.e. the temperature of the refrigerant flowing into the temperature sensing portion of the expansion valve, therefore, the control pressure of the expansion valve is also undesirably increased. Especially in the case where the intake air temperature of the gas cooler is high such as during the idling, for example, the refrigerant temperature at the outlet of the gas cooler increases to such an extent that the control pressure reaches the upper limit of the high pressure. In order to suppress the increase in the high pressure, therefore, the compressor capacity is required to be decreased, thereby posing the problem that the cooling capacity is considerably reduced. In the case where the pressure further increases to a still higher abnormal level, the compressor may be stopped.

SUMMARY OF THE INVENTION

Accordingly, it is an object of this invention to solve the aforementioned problems and to provide a supercritical cycle in which an internal heat exchanger is arranged between the devices to facilitate the mounting thereof while, at the same time, shortening the piping length.

Another object of the invention is to provide a supercritical cycle in which the control pressure of the expansion valve is prevented from increasing extremely with the excessive increase in the refrigerant temperature at the outlet of the gas cooler thereby avoiding the reduction in the capacity of the compressor due to the pressure increase or the stoppage of the compressor due to the preventive measure taken to prevent an abnormal pressure increase.

Still another object of the invention is to provide an expansion valve which can be used with a refrigeration cycle having a bypass for the internal heat exchanger.

In order to achieve these objects, according to one aspect of the invention, there is provided a supercritical cycle as a means comprising a bypass (51) extending from the high-pressure upstream side or a middle part of an internal heat exchanger (45), a temperature sensing portion (47) for controlling a main valve portion (39), a temperature sensing path (5) for supplying the refrigerant from the bypass (51) to the temperature sensing portion (47), and a refrigerant return path (53) for supplying the refrigerant from the temperature sensing portion (47) to the refrigerant path downstream of the main valve portion (39).

With this means, the internal heat exchanger can be easily mounted by being arranged between the devices while at the same time shortening the piping length.

According to another aspect of the invention, there is provided a supercritical cycle as a means in which the refrigerant return path (53), the main valve portion (39) and the temperature sensing portion (47) are formed integrally as an expansion valve (37). Thus, a compact expansion valve can be realized.

According to still another aspect of the invention, there is provided a supercritical cycle as a means in which the refrigerant return path (53) is formed in the body (49) of the expansion valve (37). The expansion valve can thus be reduced in size.

According to yet another aspect of the invention, there is provided a supercritical cycle as a means in which the body (49) of the expansion valve (37) is formed with a through hole (68) passing from the temperature sensing portion (47) to the main valve portion (39) through the body (49), wherein a valve rod (69) reaching the main valve portion (39) from the temperature sensing portion (47) is slidably inserted in the through hole (68), and the valve rod (69) is formed with an orifice (53*a*) reaching the main valve portion (39) from the temperature sensing portion (47). By doing so, a more compact expansion valve is realized.

According to a further aspect of the invention, there is provided a supercritical cycle as a means in which the bypass (51) is assembled integrally with the internal heat exchanger (45). Therefore, the bypass (51) can be arranged along the internal heat exchanger (45), thereby making possible a compact layout as a whole.

According to a still further aspect of the invention, there is provided a supercritical cycle as a means in which the bypass (51) branches from a connector (88) on the high-pressure side of the internal heat exchanger (45). In this configuration, the number of ports for connecting the devices can be reduced.

According to a yet further aspect of the invention, there is provided a supercritical cycle as a means in which the upstream end of the bypass (51) and the upstream end of the internal heat exchanger (45) are connected to a radiator (35) by a single coupler (87), and the downstream end of the bypass (51) and the downstream end of the internal heat exchanger (45) are connected to the temperature sensing path (5) and the expansion valve (37), respectively, by a single coupler (98). Thus, the number of the couplers can be reduced.

According to another aspect of the invention, there is provided a supercritical cycle as a means comprising a mixing portion (103) formed at an intermediate part of the bypass (51) and a mixing path (107) extending to the mixing portion (103) from an intermediate point of a path leading from a middle point on the high-pressure side or the downstream side of the internal heat exchanger (45) to the main valve portion (39), wherein the mixing portion (103) mixes the refrigerant from the bypass (51) with the refrigerant from the mixing path (107) at an arbitrary ratio and supplies the mixture to the temperature sensing path (5).

With this means, the control pressure of the expansion valve is prevented from being extremely increased with the excessive temperature increase, if any, of the refrigerant at the outlet of the gas cooler. Thus, the reduction in the compressor capacity due to the increased pressure or the stoppage of the compressor due to the measure taken to prevent the abnormally high pressure can be avoided.

According to still another aspect of the invention, there is provided a supercritical cycle as a means in which the refrigerant from the bypass (51) and the refrigerant from the mixing path (107) are mixed and adjusted in the range of 0 to 100% based on the temperature of at least one of the refrigerant flowing from the bypass (51) into the mixing portion (103) and the refrigerant flowing from the mixing path (107) into the mixing portion (103). With this means, the refrigerant at the outlet of the gas cooler and the refrigerant at the outlet of the internal heat exchanger can be mixed based on the temperature of at least one of the refrigerant at the outlet of the gas cooler and the refrigerant at the outlet of the internal heat exchanger, thereby making it possible to control the temperature of the refrigerant flowing into the temperature sensing portion.

According to yet another aspect of the invention, there is provided a supercritical cycle as a means in which the refrigerant from the bypass (51) and the refrigerant from the mixing path (107) are mixed and adjusted in the range of 0 to 100% based on the pressure of the bypass (51) or the mixing path (107). In accordance with the outlet pressure of the gas cooler, therefore, the refrigerant at the outlet of the gas cooler and the refrigerant at the outlet of the internal heat exchanger can be mixed with each other, so that the temperature of the refrigerant flowing into the temperature sensing portion (47) can be controlled.

According to a further aspect of the invention, there is provided a supercritical cycle as a means in which the refrigerant from the bypass (51) and the refrigerant from the mixing path (107) can be mixed and adjusted in such a manner that the temperature of the refrigerant flowing into the temperature sensing portion (47) may not exceed a predetermined temperature. Therefore, the control pressure of the expansion valve is prevented from extremely increasing, thereby making it possible to avoid the reduction in the compressor capacity due to the increased pressure or the stoppage of the compressor due to the abnormally high pressure.

According to a still further aspect of the invention, there is provided a supercritical cycle as a means in which the mixing portion (103) is integrated with the expansion valve (37) or the internal heat exchanger (45). Therefore, a compact layout of the devices as a whole is made possible.

According to a yet further aspect of the invention, there is provided a supercritical cycle as a means comprising the internal heat exchanger (45) as a main internal heat exchanger (45), the bypass (51) as a first bypass (51), a second bypass (153) arranged in parallel to the low-pressure side of the main internal heat exchanger (45) and through which the low-pressure side refrigerant flows, and a subsidiary heat exchanger (155) for reducing the temperature of the refrigerant flowing in the temperature sensing portion (47) through the first bypass (51) by exchanging heat between the refrigerant flowing in the second bypass (153) and the refrigerant flowing in the first bypass (51). In accordance with the temperature of the refrigerant flowing into the temperature sensing portion, therefore, the low-pressure side flow rate of the refrigerant flowing into the subsidiary heat exchanger can be adjusted, so that the temperature of the refrigerant flowing into the temperature sensing portion (47) can be controlled within a predetermined temperature range.

According to another aspect of the invention, there is provided an expansion valve as a means comprising a main valve portion (39) for expanding the refrigerant from the high to low pressure side of the refrigeration cycle, a temperature sensing portion (47) for controlling the main valve portion (39), a temperature sensing path (5) for introducing the refrigerant into the temperature sensing portion (47) from the upstream side or a middle point of the high-pressure side of the internal heat exchanger (45) for exchanging heat between the refrigerant downstream of the radiator of the refrigeration cycle and the refrigerant upstream of the compressor, and a refrigerant return path (53) for supplying the refrigerant from the temperature sensing portion (47) to the refrigerant path downstream of the main valve portion (39). As a result, the internal heat exchanger is arranged between the devices and thus can be easily mounted. At the same time, the piping length can be shortened and a compact expansion valve realized.

The present invention may be more fully understood from the description of preferred embodiments of the invention, as set forth below, together with the accompanying drawings.

DESCRIPTION OF THE PREFERRED EMBODIMENTS

Embodiments of the invention are explained below with reference to FIGS. 1 to 10.

Figure 1:
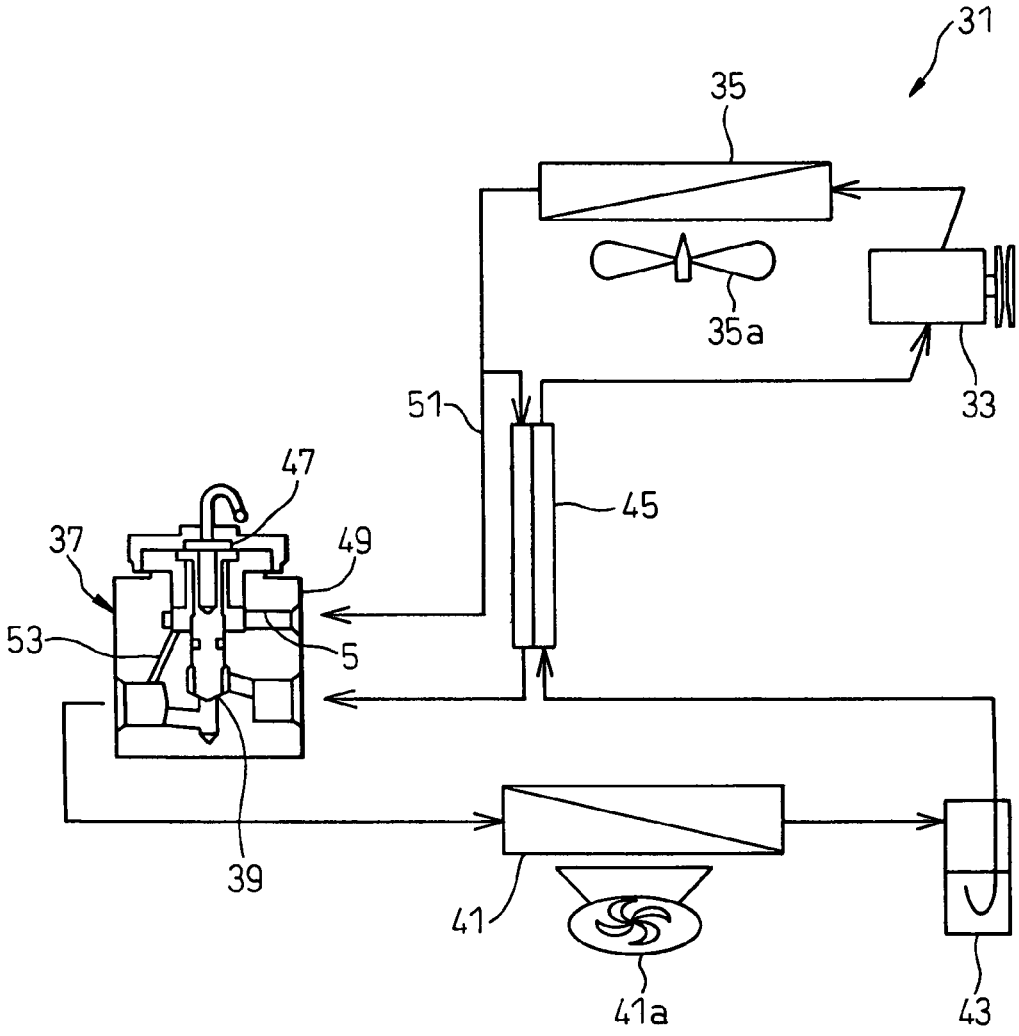
FIG. 1 is a diagram showing a supercritical cycle according to a first embodiment of the invention.
Figure 2B:
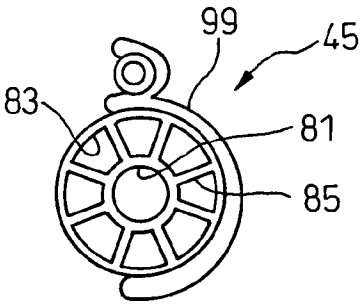
FIG. 2A is a sectional view schematically showing a heat exchanger and a pressure control valve in the supercritical cycle shown in FIG. 1, and FIG. 2B a sectional view taken in line A-A in FIG. 2A.
Figure 2A:
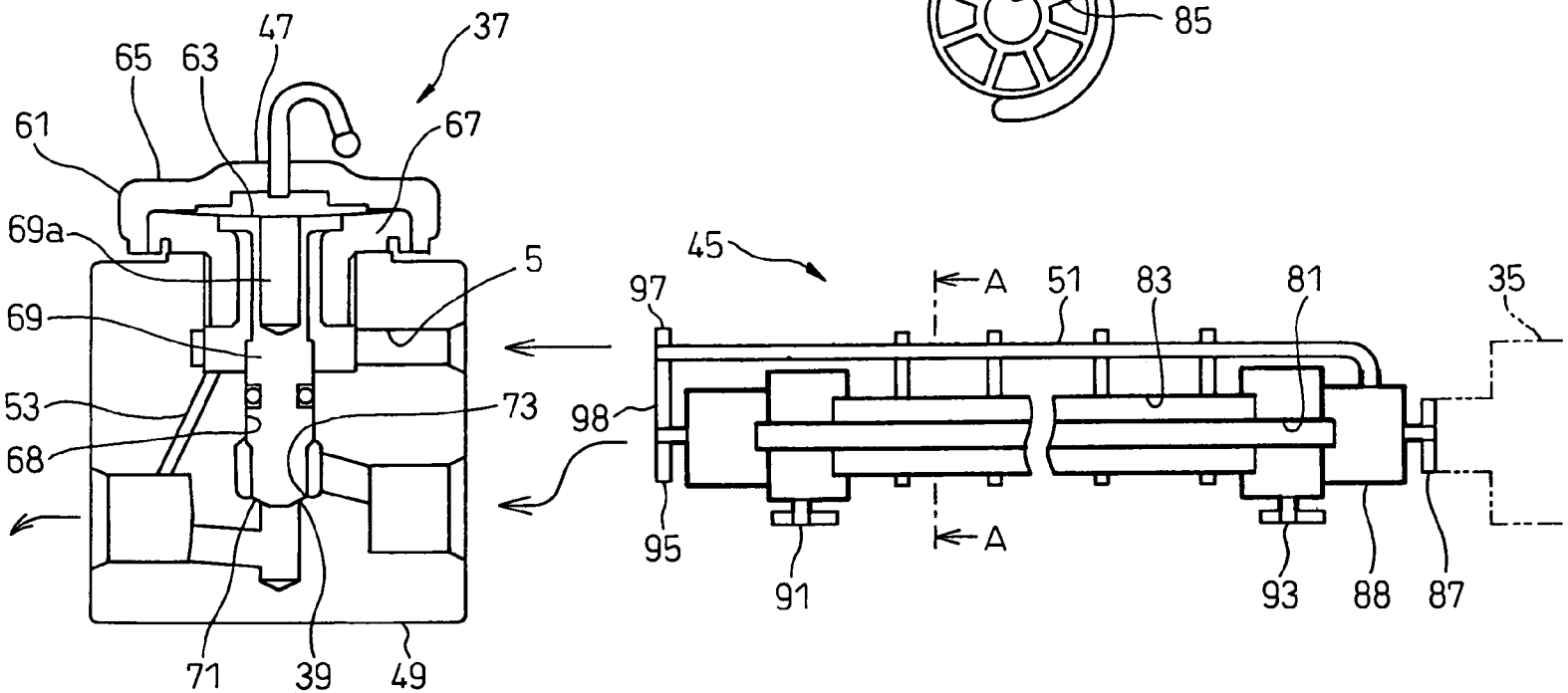

FIGS. 1, 2A, 2B show a supercritical cycle 31 according to a first embodiment. This supercritical cycle 31 includes a compressor 33, a gas cooler 35 providing a radiator as an outdoor heat exchanger, a main valve portion 39 of an expansion valve 37, an evaporator 41 as an indoor heat exchanger, an accumulator 43 and the compressor 33 arranged in that order, and the refrigerant is circulated in the same order. The gas cooler 35 is also called a condenser in the refrigeration cycle with the refrigerant not pressured to the supercritical pressure in the high-pressure side pipe. The opening degree of the expansion valve 37 is adjusted to maintain the high-pressure side of the refrigeration cycle at a predetermined high pressure. For this reason, the expansion valve 37 is also called a pressure control valve. Also, an internal heat exchanger 45 for exchanging heat between the refrigerant downstream of the gas cooler and the refrigerant upstream of the compressor is arranged in the refrigerant path between the accumulator 43 and the compressor 33 and the refrigerant path between the outdoor gas cooler 35 and the main valve portion 39 of the expansion valve 37. The compressor 33 compresses the refrigerant into a high pressure. The refrigerant thus compressed is cooled by the air from outside the passenger compartment blown by a fan 35*a* in the gas cooler 35. The internal heat exchanger 45 reduces the enthalpy of the refrigerant by moving heat to the low-pressure refrigerant downstream of the accumulator 43 and upstream of the compressor 33 from the high-pressure refrigerant downstream of the gas cooler 35. The expansion valve 37, through the main valve body 39 thereof, controls the high-pressure side pressure of the refrigeration cycle to a predetermined desired high pressure in such a manner as to maximize or substantially maximize the COP indicating the efficiency of the refrigeration cycle. The refrigerant supplied to the low-pressure side from the expansion valve 37 is gasified by the evaporator 41 to thereby cool the air. The air cooled by the refrigerant is supplied into the passenger compartment by a blower 41*a*. The refrigerant passed through the evaporator 41 flows into the accumulator 43, where the gas refrigerant and the liquid refrigerant supplied from the evaporator 41 are separated from each other so that the gas refrigerant and the lubricating oil circulating with the refrigerant are sucked into the compressor 33. The main valve portion 39 of the expansion valve 37, together with the temperature sensing portion 47 for detecting the refrigerant temperature, is integrated with a body 49 of an aluminum material. The main valve portion 39 is provided by an annular path defined between the valve body 71 as a movable valve unit and a valve seat 73 as a fixed valve seat arranged in the hole formed in the body 49. The body 49 includes a temperature sensing path 5 extending from the outer surface thereof to the temperature sensing portion 47 thereby to introduce the temperature sensing refrigerant into the temperature sensing portion 47.

In this configuration, the bypass 51 branches from the path extending from the gas cooler 35 to the internal heat exchanger 45. This bypass 51 is connected to the temperature sensing path 5 reaching the temperature sensing portion 47. Also, the body 49 has formed therein an orifice 53 extending to the downstream side of the main valve portion 39 from the temperature sensing portion 47. The refrigerant that has flowed in from the gas cooler 35 is sent through the bypass 51 to the temperature sensing portion 47 where the main valve portion 39 of the expansion valve 37 is controlled to decompress the refrigerant in such a manner as to maximize the COP in accordance with the refrigerant temperature. The refrigerant that has passed through the temperature sensing portion 47 is decompressed through the orifice 53 and merges with the refrigerant passed through the main valve portion 39.

FIG. 2A shows a specific structure of the expansion valve 37 and the internal heat exchanger 45. In FIG. 2A, the expansion valve 37 has a body 49 made of aluminum. An element unit 61 is mounted on the body 49. The element unit 61 is formed by sandwiching a diaphragm of a metal film 63 between a cover 65 and a flange 67 and welding or otherwise coupling the outer peripheral portion hermetically. The diaphragm 63 has an operating rod 69 coupled on the lower surface thereof, and the space 69*a* in the operating rod 69 communicates with the space between the diaphragm 63 and the cover 65 through a hole (not shown) formed in the diaphragm 63. The $CO_2$ gas and a gas ($N_2$, He, etc.), smaller in pressure change with temperature than $CO_2$ gas, are sealed with a predetermined density in the space between the diaphragm 63 and the cover 65, respectively. The operating rod 69 is inserted vertically movably in the through hole 68 formed from the temperature sensing portion 47 to the main valve portion 39 through the body 49. A valve unit 71 is formed at the lower end of the operating rod 69; This valve unit 71 is in contact with the valve seat 73 on the body side at the time of opening and, upon the upward displacement of the diaphragm 63, opens with a predetermined opening degree by coming away from the valve seat 73 due to the movement of the operating rod 69.

The gas is sealed in the diaphragm 63 in such a manner that the COP associated with pressure becomes a maximum at a given temperature. The temperature of the influent refrigerant at the outlet of the gas cooler is detected mainly by the temperature sensing portion (the portion sealed with a gas in the space) of the operating rod, and the valve opening degree is changed by the displacement of the diaphragm due to the difference between the sealed gas pressure and the high pressure thereby to control the high pressure.

The element unit 61 is assembled on the body 49 with a screw formed on the flange 67, and contains an orifice 53 whereby the refrigerant passed through the temperature sensing portion 45 is decompressed and supplied to the downstream side of the valve.

In FIG. 2A, reference numeral 45, designates a longitudinal sectional view of the internal heat exchanger of double tube type. This internal heat exchanger 45, as shown in FIG. 2B, contains a high-pressure refrigerant path 81 with a high-pressure refrigerant flowing therein and a low-pressure refrigerant path 83 formed on the outer periphery thereof with a low-pressure refrigerant flowing therein. The pipe of the inner high-pressure refrigerant path 81 is supported on the pipe of the low-pressure refrigerant path 83 by a rib 85.

The refrigerant cooled by the gas cooler 35 flows into the internal heat exchanger 45 by way of a joint portion 87, and branches into the bypass 51 and the high-pressure refrigerant path 81 at the upstream end 88. The low-pressure gas refrigerant from the accumulator 43 flows in from the joint portion 91 at the outlet of the high-pressure refrigerant to improve the heat exchange efficiency and, while passing through the low-pressure refrigerant path 83, exchanges heat with the high-pressure refrigerant in the high-pressure refrigerant path 81. This low-pressure gas refrigerant is supplied from the joint portion 93 to the compressor 33. The high-pressure refrigerant that has passed through the high-pressure refrigerant path 81, on the other hand, flows to the upstream side of the main valve portion 39 of the expansion valve 37 from the joint portion 95, and the refrigerant that has passed through the bypass 51 flows to the temperature sensing portion 47 of the expansion valve 37 from the joint portion 97. The joint portions 95, 97 share a single fixing plate 98 and therefore can be assembled on the expansion valve 37 at the same time. Also, the bypass 51, extending along the same route as the internal heat exchanger 45, is assembled integrally with the internal heat exchanger 45 by a fixing jig 99.

As explained above, in this supercritical cycle 31, the evaporator 41, the compressor 33, the gas cooler 35 and the main valve portion 39 of the expansion valve 37 are arranged in that order, and the refrigerant is circulated in the same order. The internal heat exchanger 45 exchanges heat between the high-pressure side refrigerant flowing toward the main valve portion 39 of the expansion valve 37 from the gas cooler 35 and the low-pressure side refrigerant flowing toward the compressor 33 from the evaporator 41. The expansion valve 37, in addition to the main valve portion 39, has the temperature sensing portion 47 integrally therewith to control the main valve portion 39, and the bypass 51 supplies the refrigerant to the temperature sensing portion 47 from the upstream side or a middle point of the portion of the internal heat exchanger 45 where the high-pressure side refrigerant flows. The orifice 53 for supplying the refrigerant from the temperature sensing portion 47 to the refrigerant circuit downstream of the main valve portion 39 is arranged on the body 49.

As a result, the refrigerant that has passed through the temperature sensing portion 47 is not required to be returned to the internal heat exchanger 45, nor is the internal heat exchanger 45 required to make a U-turn to the expansion valve 37. As a result, the internal heat exchanger 45 can be arranged between the gas cooler 35 and the expansion valve 37, and extraneous space for arranging the internal heat exchanger 45 is not required around the expansion valve 37. Thus, the pipe connecting the gas cooler 35 and the expansion valve 37 can be reduced in length.

Also, the refrigerant passed through the temperature sensing portion 47 is decompressed through the orifice formed in the body 49, and can be merged with the downstream side of the main valve portion 39 of the expansion valve 37 in the body 49. Therefore, the path toward the internal heat exchanger 45 from the temperature sensing portion 47 is eliminated, thereby making it possible to omit the pipe connector at the outlet of the temperature sensing portion 47.

Further, the bypass 51 branching from the upstream end or a middle point of the internal heat exchanger 45 is integrally assembled in parallel to the internal heat exchanger 45. The upstream end of the bypass 51 and the upstream end of the internal heat exchanger 45 are connected to the gas cooler 35 with a single coupler 87. Similarly, the downstream end of the bypass 51 and the downstream end of the internal heat exchanger 45 are connected to the expansion valve 37 with a single coupler 95, 97. Thus, the internal heat exchanger 45 and the bypass 51 can be integrated with each other as a compact assembly, while at the same time connecting the gas cooler 35 and the expansion valve 37 easily and in simplistic fashion.

Figure 3:
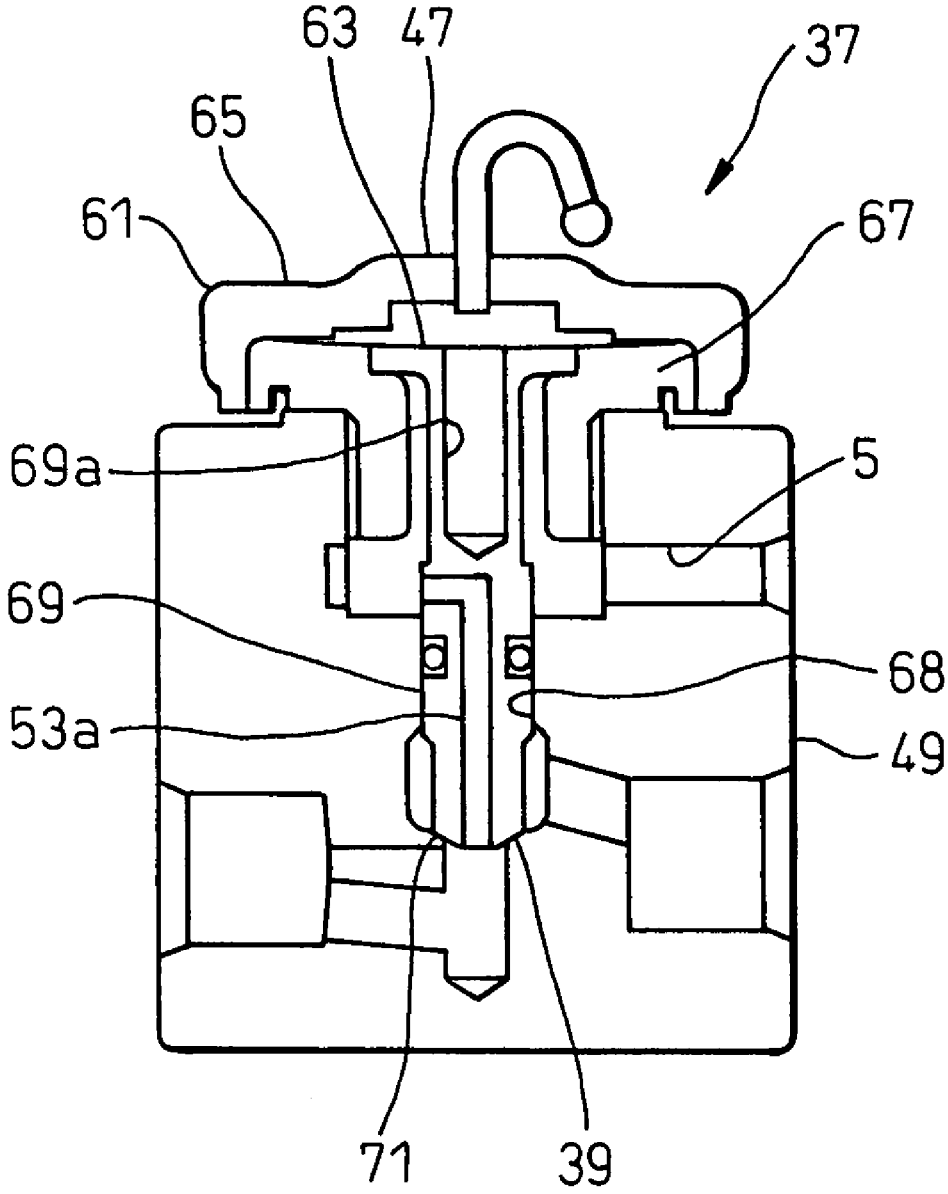
FIG. 3 shows another example of an orifice included in an expansion valve.

According to the embodiment described above, the orifice 53 is formed as a through hole in the body 49. The invention, however, is not necessarily limited to this configuration but, as shown in FIG. 3, the operating rod 69 extending from the temperature sensing portion 47 to the main valve portion 39 may be inserted slidably into the body 49, and formed with the orifice 53*a* extending from the temperature sensing portion 47 to the downstream side of the valve through the main valve portion 39.

Figure 4:
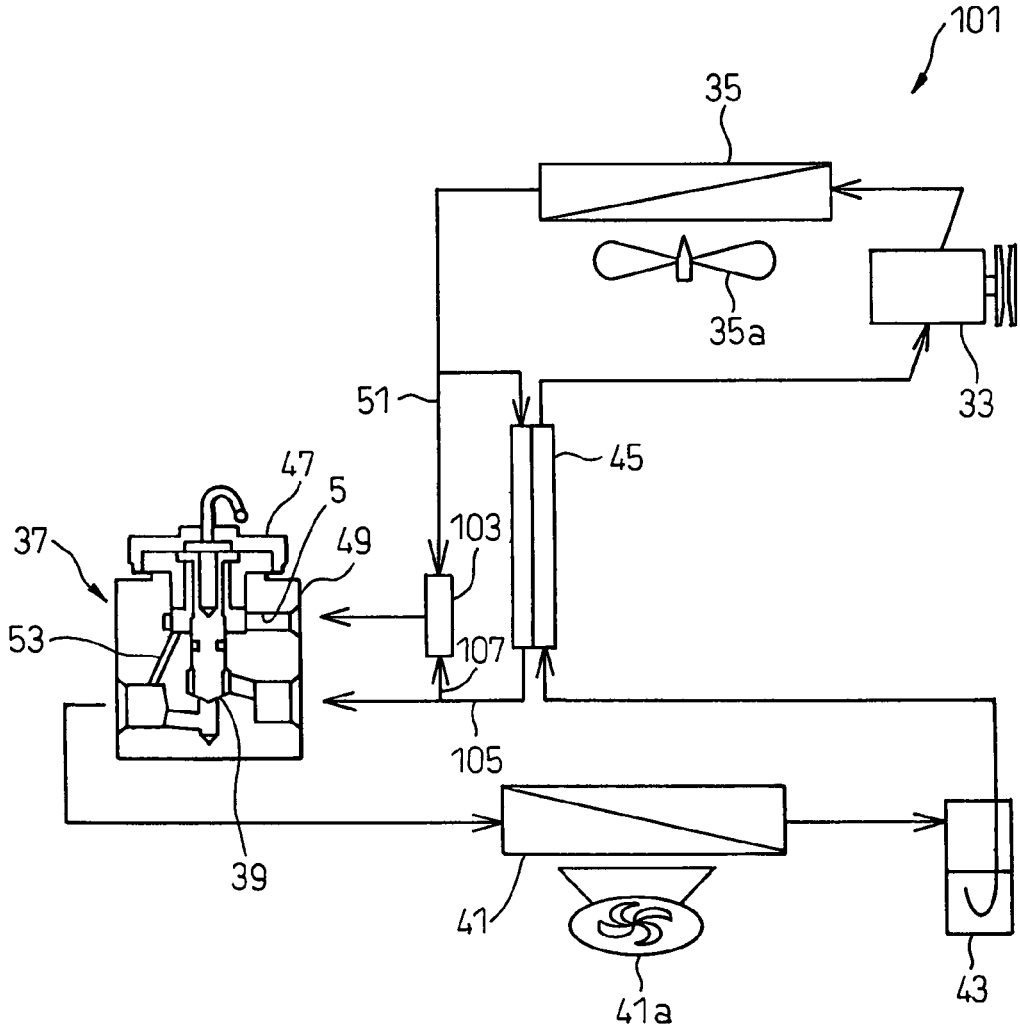
FIG. 4 is a diagram showing a supercritical cycle according to a second embodiment of the invention.

FIG. 4 shows the supercritical cycle according to second embodiment. This supercritical cycle 101 is equivalent to the supercritical cycle 31 shown in FIG. 1, in which a mixing portion 103 is arranged at an intermediate part of the bypass 51, and a mixing path 107 branches to the mixing portion 103 from the path 105 at the outlet of the internal heat exchanger 45 extending from the outlet of the internal heat exchanger 45 to the main valve portion 39 of the expansion valve 37. The refrigerant in the bypass 51 of the internal heat exchanger 45 and the refrigerant at the outlet of the internal heat exchanger 45 are mixed at an arbitrary ratio so that the temperature of the refrigerant flowing into the temperature sensing portion 47 through the temperature sensing path 5 may not exceed a predetermined level.

The control pressure of the expansion valve for the $CO_2$ refrigerant is determined in accordance with the refrigerant temperature and, therefore, the control pressure can be changed by changing the temperature of the refrigerant flowing into the temperature sensing portion 47.

Normally, a high pressure is used in the supercritical state and, therefore, an excessive increase in the temperature at the outlet of the gas cooler 35 would cause an inconvenience in which the control pressure reaches the upper limit of the high pressure. As long as the temperature of the refrigerant flowing into the temperature sensing portion 47 of the supercritical cycle 101 is not higher than a predetermined value, therefore, the mixing portion 103 supplies the temperature sensing portion 47 with the refrigerant at the outlet of the gas cooler which has flowed in through the bypass 51 and, once the predetermined temperature is reached, the refrigerant passed through the outlet path 105 of the internal heat exchanger 45 is mixed with the refrigerant at the outlet of the gas cooler 35 so that the refrigerant flowing into the temperature sensing portion 47 is maintained at not higher than a predetermined temperature. In this way, the control pressure of the expansion valve 37 is prevented from excessively increasing thereby to suppress the abnormally high pressure and, therefore, the reduction in compressor capacity and the compressor stoppage are prevented.

Figure 5:
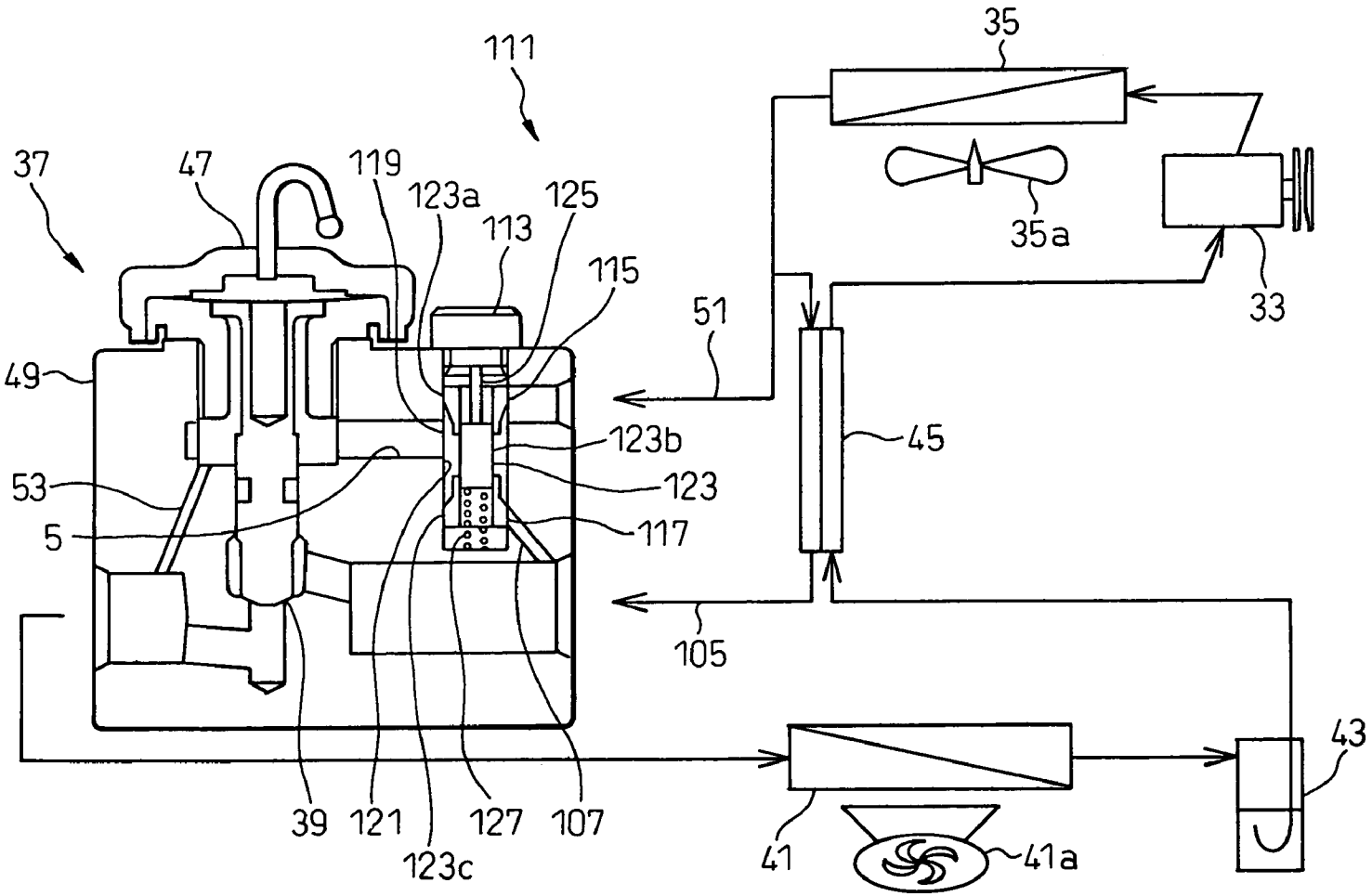
FIG. 5 is a sectional view of a pressure control valve and a diagram showing a supercritical cycle according to a third embodiment of the invention.

FIG. 5 shows the supercritical cycle according to a third embodiment. This supercritical cycle 111 has a constant temperature valve 113 as a specific example of the mixing portion 103 of the supercritical cycle 101 shown in FIG. 4. This constant temperature valve 113 is arranged in the body 49 of the expansion valve 37, and the mixing portion 107 is also formed on the body 49. The constant temperature valve 113 is formed of a high-temperature side port 115 connected to the bypass 51, a low-temperature side port 117 connected to the mixing path 107 and a temperature-sensing-portion side port 119 connected to the temperature sensing portion 45 through the temperature sensing path 5. Also, a spool 123 having an upper large-diameter portion 123*a*, a middle small-diameter portion 123*b* and a lower large-diameter portion 123*c* coupled to each other is inserted vertically movably into a cylinder portion 121. A piston 125 is arranged above the spool 123. With the increase in temperature, the wax in the temperature-sensing operating unit of the piston 125 is melted and the piston 125 is pushed up. Thus, the piston 125 is projected at high temperatures and contracted at low temperatures. A spring 127 for pressuring the spool 123 upward is arranged under the spool 123.

Figure 6A:
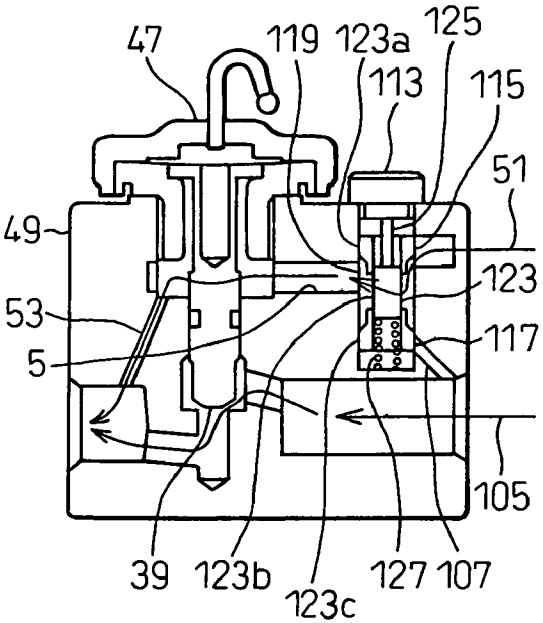
FIG. 6A shows the low-temperature operation of the pressure control valve shown in FIG. 5.
Figure 7:
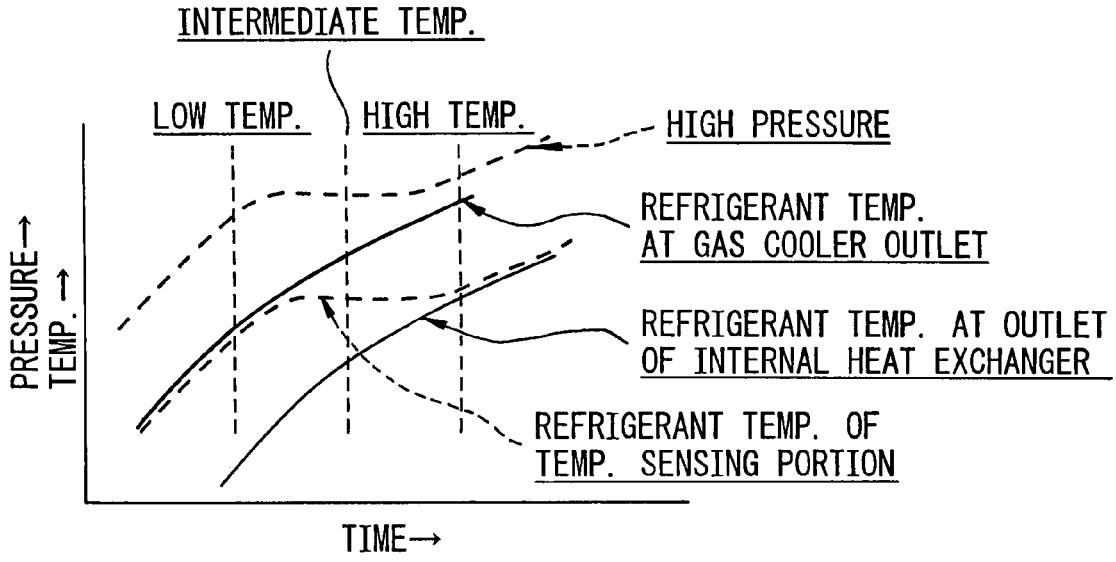
FIG. 7 is a diagram showing the temperature and pressure of the various parts in the low-, middle- and high-temperature operations shown in FIGS. 6A, 6B, 6C, respectively.

In this configuration, at low temperatures, as shown in FIG. 6A, the piston 125 is contracted and, therefore, the spool 123 is pushed up by the spring 127. Under this condition, the upper large-diameter portion 123*a* is located above the high-temperature side port 115 and the middle small-diameter portion 123*b* communicates with the high-temperature side port 115 and the temperature-sensing-portion side port 119. On the other hand, the low-temperature side port 117 is closed by the lower large-diameter portion 123*c*. The refrigerant from the bypass 51, i.e. the refrigerant at the outlet of the gas cooler 35 enters by way of the high-temperature side port 115, and flowing out from the temperature-sensing-portion side port 119, reaches the temperature sensing portion 47 through the temperature sensing path 5. As a result, as shown in FIG. 7, the refrigerant temperature in the temperature sensing portion 47 becomes equal to the refrigerant temperature at the outlet of the gas cooler 35 and the pressure is controlled at a corresponding level.

Figure 6B:
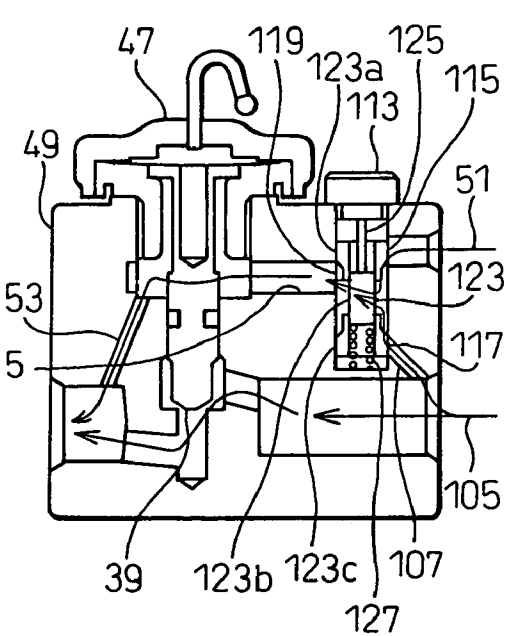
FIG. 6B shows the middle-temperature operation of the pressure control valve shown in FIG. 5.

Next, with the increase in the temperature at the outlet of the gas cooler 35 to the middle level, as shown in FIG. 6B, the piston 125 is slightly projected against the pressure of the spring 127, and the spool 123 is held at the middle position. Under this condition, the upper large-diameter portion 123*a* is located slightly above the high-temperature side port 115, the lower large-diameter portion 123*c* is located slightly under the lower-temperature side port 117, and the middle small-diameter portion 123*b* communicates with the high-temperature side port 115, the low-temperature side port 117 and the temperature-sensing-portion side port 119. Therefore, the refrigerant from the bypass 51, i.e. the refrigerant at the outlet of the gas cooler 35 and the refrigerant at the outlet of the internal heat exchanger 45 that has passed through the mixing path 107 are mixed in the middle small-diameter portion 123*b*, and flowing out from the temperature-sensing-portion side port 119, reaches the temperature sensing portion 47 through the temperature sensing path 5. As a result, the refrigerant at the outlet of the gas cooler 35 and the refrigerant at the outlet of the internal heat exchanger 45 can be mixed with each other in such a manner that the temperature of the refrigerant flowing into the temperature sensing portion 47 is substantially constant, and as shown in FIG. 7, the control pressure can also be maintained at a substantially constant level.

Figure 6C:
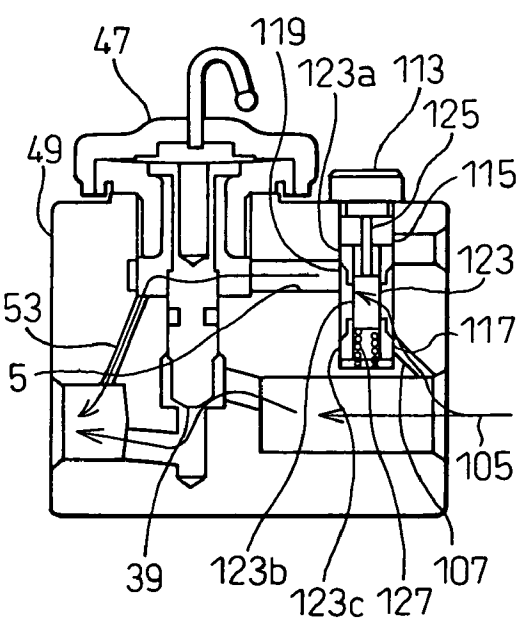
FIG. 6C shows the high-temperature operation of the pressure control valve shown in FIG. 5.

With a further increase of the temperature at the outlet of the gas cooler 35 to a high level, as shown in FIG. 6C, the piston 125 is further projected against the pressure of the spring 127, and the spool 123 is held at a lower position. Under this condition, the lower large-diameter portion 123*c* is located under the low-temperature side port 117, and the middle small-diameter portion 123*b* communicates with the low-temperature side port 115 and the temperature-sensing-portion side port 119. The high-temperature side port 115, on the other hand, is closed by the upper large-diameter portion 123*a*. Therefore, only the refrigerant from the mixing path 107, i.e. only the refrigerant at the outlet of the internal heat exchanger 45 flows out from the low-temperature side port 117 to the temperature-sensing-portion side port 119 and, through the temperature sensing path 5, reaches the temperature sensing portion 47. As a result, as shown in FIG. 7, the main valve portion 39 of the expansion valve 37 is controlled by a lower pressure than when controlled by the temperature at the outlet of the gas cooler 35.

As described above, in this supercritical cycle 111, the constant temperature valve 113 is arranged as the mixing portion 103, and therefore, the refrigerant at the outlet of the gas cooler 35 and the refrigerant at the outlet of the internal heat exchanger 45 can be mixed with each other based on the temperature of at least one of the refrigerant from the bypass 51, i.e. the refrigerant at the outlet of the gas cooler 35 and the refrigerant from the mixing path 107, i.e. the refrigerant at the outlet of the internal heat exchanger 45. Thus, the temperature of the refrigerant flowing into the temperature sensing portion 47 can be controlled.

Figure 8:
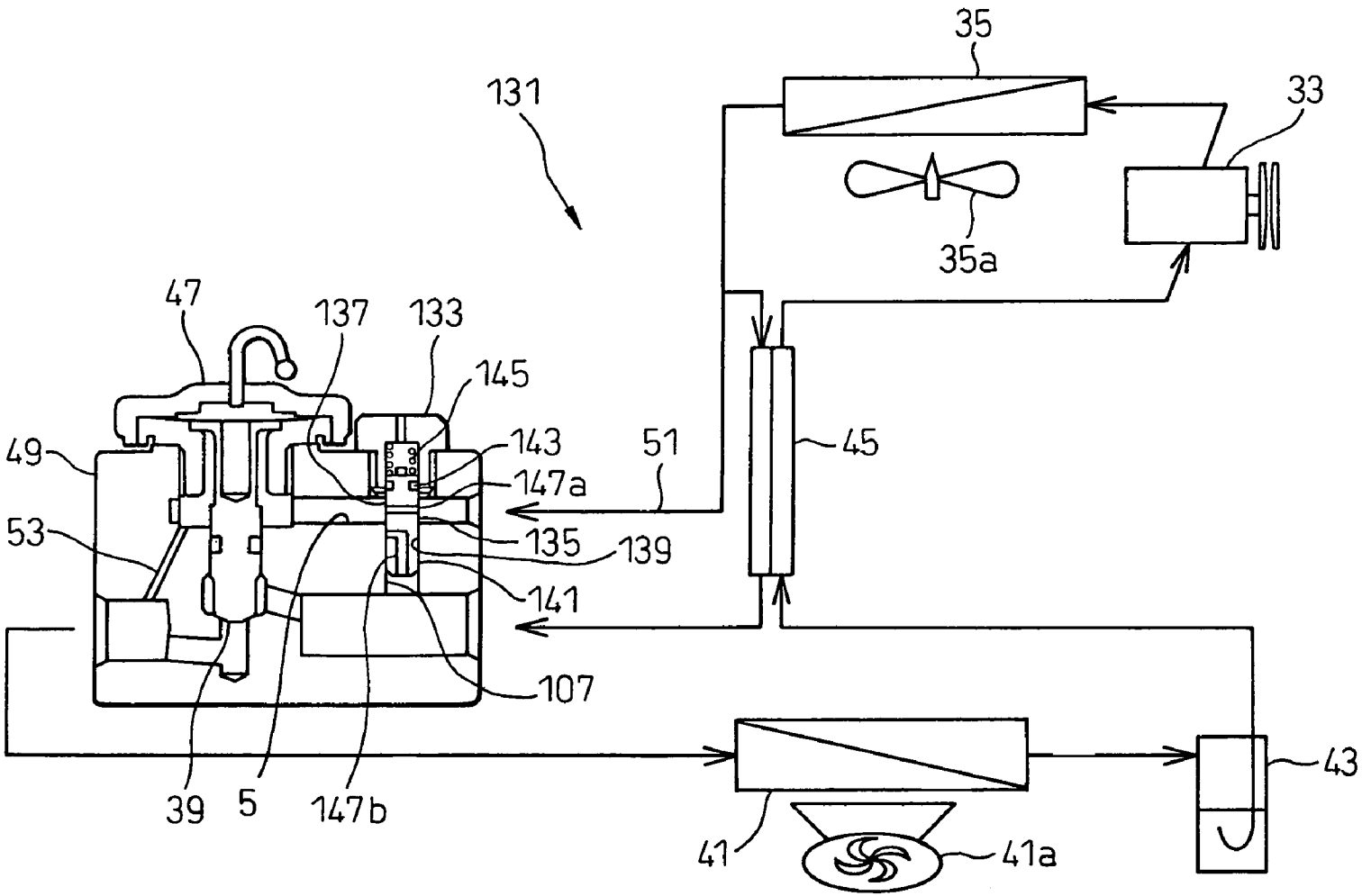
FIG. 8 is a sectional view showing a pressure control valve and a supercritical cycle according to a fourth embodiment of the invention.

FIG. 8 shows a supercritical cycle according to a fourth embodiment. This supercritical cycle 131 is equivalent to the supercritical cycle 101 shown in FIG. 4 in which a constant pressure valve 133 is included as a specific example of the mixing portion 103. The constant pressure valve 133 is arranged in the body 49 of the expansion valve 37, and so is the mixing path 107. The constant pressure value 133 is formed with the high-temperature side port 135 connected to the bypass 51 and the temperature-sensing-portion side port 137 connected to the temperature sensing portion 47 through the temperature sensing path 5.

An operating portion 141 formed with a refrigerant path therein is inserted vertically and movably in the cylinder portion 139 through an O-ring 143. The spring 145 is arranged above the operating portion 141 and presses the latter downward. Once the difference with the atmospheric pressure exceeds a predetermined value, the operating portion 141 is pushed up against the pressure of the spring 145. This operating portion 141 is formed with an upper communication hole 147*a* open to both sides of the upper portion thereof, and a lower communication hole 147*b* open to both the temperature sensing portion 47 and the bottom thereof.

Figure 9A:
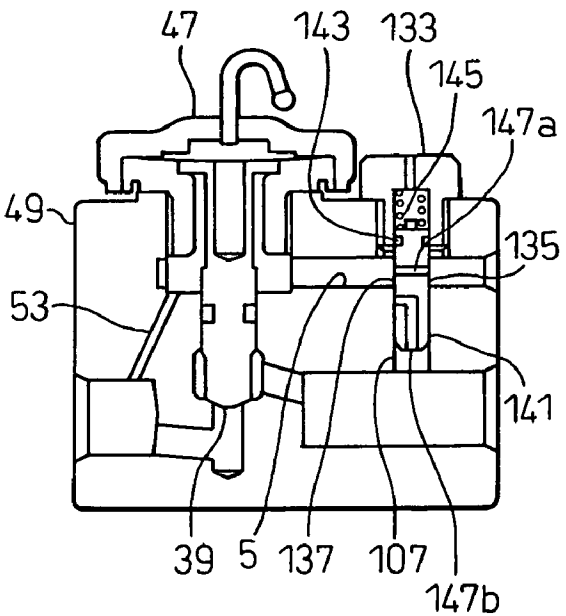
FIG. 9A is a sectional view showing the low-pressure operation of the pressure control valve shown in FIG. 8.

In this configuration, under a low pressure, as shown in FIG. 9A, the operating portion 141 is located at a lower position by the spring 145. Under this condition, the upper communication hole 147*a* communicates with the high-temperature side port 135 and the temperature-sensing-portion side port 137, and the refrigerant at the outlet of the gas cooler 35 from the bypass 51 flows through the temperature sensing path 5 to the temperature sensing portion 47. On the other hand, the lower communication hole 147*b* is closed, and the refrigerant at the outlet of the internal heat exchanger 45 from the mixing path 107 is prevented from flowing into the temperature sensing portion 47. As a result, as shown in FIG. 7, the refrigerant temperature of the temperature sensing portion 47 is equal to that of the refrigerant at the outlet of the gas cooler 35, and the pressure is controlled to a corresponding level.

Figure 9B:
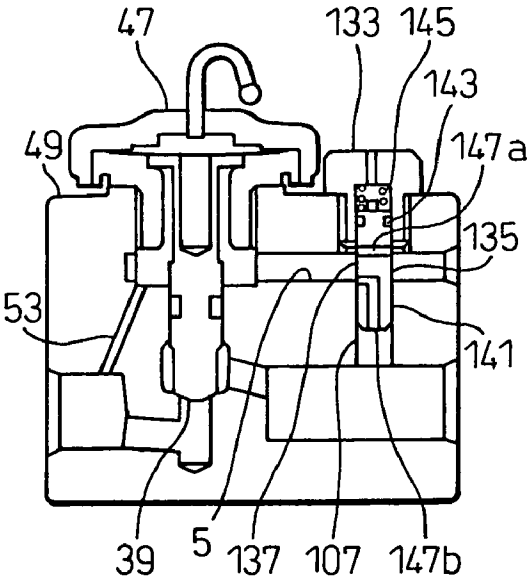
FIG. 9B is a sectional view showing the middle-pressure operation of the pressure control valve shown in FIG. 8.

Next, under a middle pressure, to which the pressure at the outlet of the gas cooler 35 increases, the operating portion 141, as shown in FIG. 9B, somewhat rises and is located at a middle position against the pressure of the spring 145. Under this condition, the upper communication hole 147*a* communicates with the high-temperature side port 135 and the temperature-sensing-portion side port 137 on the one hand, while the lower communication hole 147*b* communicates with the mixing path 107 and the temperature-sensing-portion side port 137 on the other hand. As a result, the refrigerant at the outlet of the gas cooler 35 from the bypass 51 and the refrigerant at the outlet of the internal heat exchanger 45 from the mixing path 107 are mixed in such a manner as to maintain a substantially constant high pressure, and the refrigerant mixture is supplied to the temperature sensing portion 47 through the temperature sensing path 5, thereby making it possible to control the control pressure at a substantially constant level.

Figure 9C:
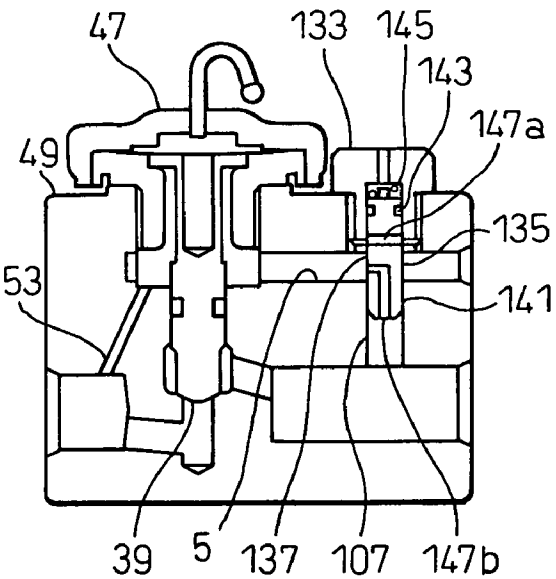
FIG. 9C is a sectional view showing the high-pressure operation of the pressure control valve shown in FIG. 8.

With a further pressure increase to a still higher level at the gas cooler outlet, as shown in FIG. 9C, the operating portion 141 further rises and closes the upper communication hole 147*a*, while at the same time opening the lower communication hole 147*b* to the full. As a result, only the refrigerant at the outlet of the internal heat exchanger 45 that has passed through the mixing path 107 flows in the temperature sensing portion 47. Subsequently, therefore, the refrigerant temperature can be controlled by a lower pressure can be used for control than the pressure associated with the temperature at the outlet of the gas cooler 35.

As described above, in the supercritical cycle 131, the constant pressure valve 133 is arranged as the mixing portion 103 and, therefore, the refrigerant at the outlet of the gas cooler 35 from the bypass 51 can be mixed with the refrigerant at the outlet of the internal heat exchanger 45 from the mixing path 107 in accordance with the outlet pressure of the gas cooler 35, thereby making it possible to control the temperature of the refrigerant flowing into the temperature sensing portion 47.

Figure 10:
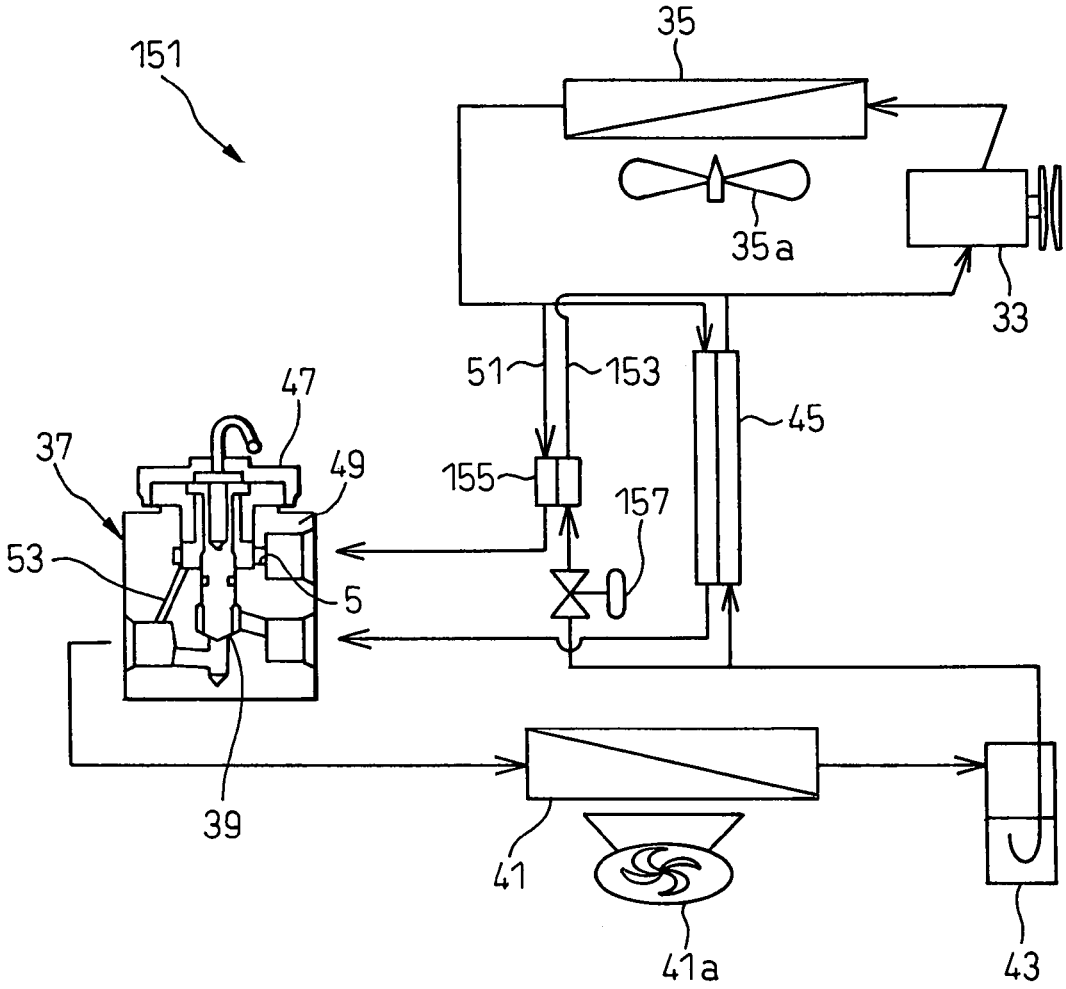
FIG. 10 is a sectional view showing a pressure control valve and a supercritical cycle according to a fifth embodiment of the invention.
Figure 11:
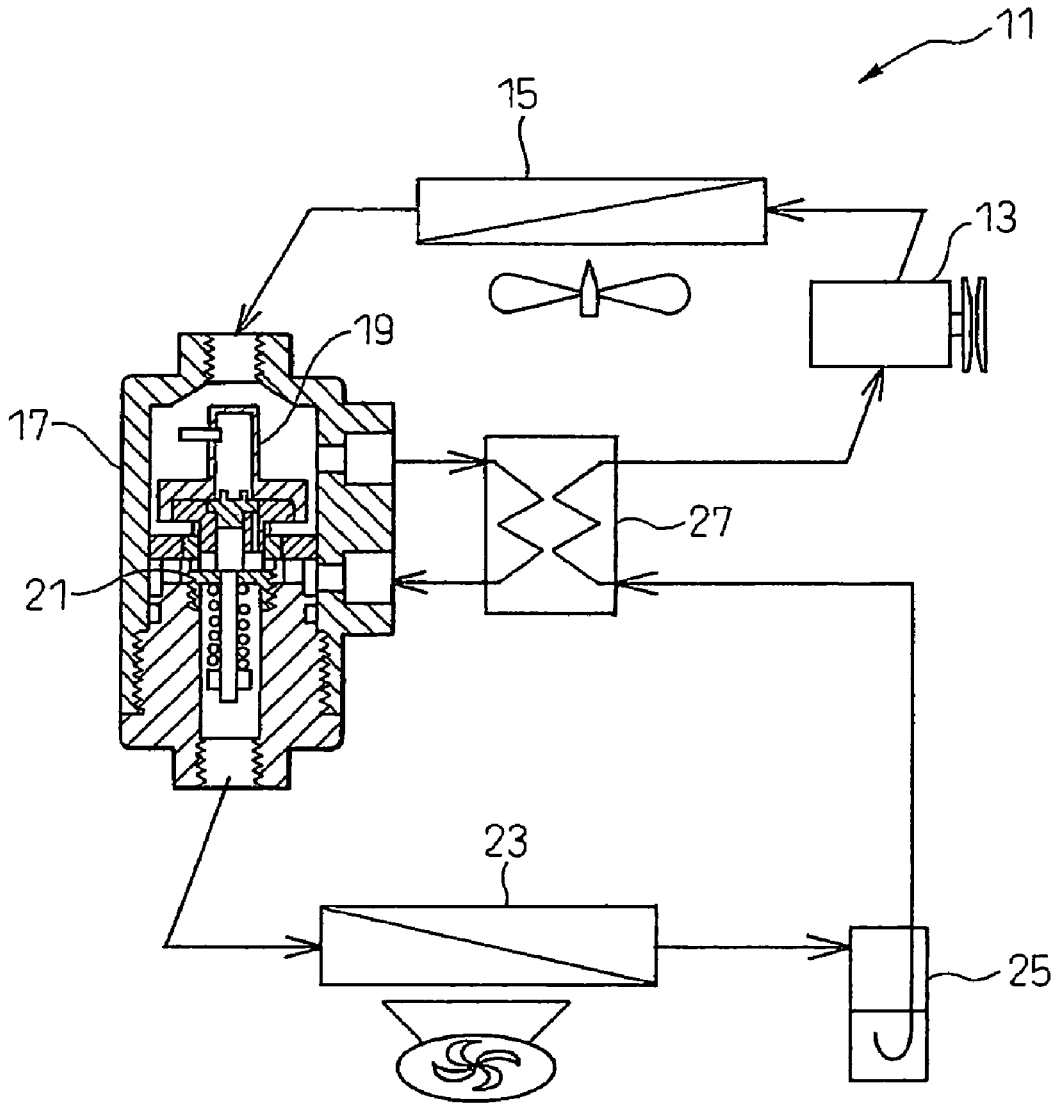
FIG. 11 PRIOR ART
FIG. 11 is a diagram showing the conventional supercritical cycle.

FIG. 10 shows the supercritical cycle according to a fifth embodiment of the invention. This supercritical cycle 151 corresponds to the supercritical cycle 31 shown in FIG. 1, in which a parallel path 153 is formed in parallel to the heat exchanger 45 between the accumulator 43 and the compressor 33, and a subsidiary heat exchanger 155 is arranged for exchanging heat between the parallel path 153 and the bypass 51. Also, a flow rate control valve 157 is arranged in series with the subsidiary heat exchanger 155 in the parallel path 153. In this way, the refrigerant flowing into the temperature sensing portion 47 of the expansion valve 37 can be cooled by the subsidiary heat exchanger 155. Specifically, once the temperature of the refrigerant flowing into the temperature sensing portion 47 through the temperature sensing path 5 reaches a predetermined temperature, the flow rate control valve 157 is activated to increase the low-pressure side flow rate of the refrigerant flowing into the subsidiary heat exchanger 155 so that the temperature of the refrigerant flowing into the temperature sensing portion 47 may be included in a predetermined temperature range.

As described above, in this supercritical cycle 151, the parallel path 153 is formed in parallel to the heat exchanger 45 between the accumulator 43 and the compressor 33, and the subsidiary heat exchanger 155 is arranged for exchanging heat between the parallel path 153 and the bypass 51. In accordance with the temperature of the refrigerant flowing into the temperature sensing portion 47, therefore, the low-pressure side flow rate of the refrigerant flowing into the subsidiary heat exchanger 155 can be adjusted. Thus, the temperature of the refrigerant flowing into the temperature sensing portion 47 can be included in the predetermined temperature range.

In the aforementioned embodiments, the bypass 51 branches from the upstream side of the internal heat exchanger 45. Nevertheless, the invention is not limited to this configuration, but the bypass 51 may alternatively branch from an intermediate part of the path in the internal heat exchanger 45. Also, in the aforementioned embodiments, the path from the internal heat exchanger 45 to the main valve portion 39 of the expansion valve 37 starts from the downstream end of the internal heat exchanger 45. Nevertheless, the invention is not limited to this configuration, but the particular path may start from an intermediate part of the path in the internal heat exchanger 45. This configuration can be realized by adding a branch portion to the internal heat exchanger or by forming the internal heat exchanger of two parts between which a branch pipe is arranged. Also, a similar branch from the intermediate part of the heat exchanger can be employed also for the subsidiary internal heat exchanger. The mixing portion 103, though integrated with the expansion valve 37 or the internal heat exchanger 45, may alternatively be provided by a path formed in the body of the expansion valve 37. As another alternative, the mixing portion 103 can be formed in a block body brazed integrally with the internal heat exchanger 45 or in the body thereof fixedly fastened by a bolt. Further, the mixing portion 103 can be formed in another block than the expansion valve 37 and the internal heat exchanger 45. In these configurations, a refrigeration cycle similar to those of the aforementioned embodiments can be formed by direct communication or the communication by piping between the various parts.

While the invention has been described by reference to specific embodiments chosen for purposes of illustration, it should be apparent that numerous modifications could be made thereto by those skilled in the art without departing from the basic concept and scope of the invention.

The invention claimed is:

1. A supercritical cycle comprising an evaporator, a compressor, a radiator and an expansion valve, the supercritical cycle further comprising:

an internal heat exchanger exchanging heat between high-pressure side refrigerant flowing toward a main valve portion of the expansion valve from the radiator and low-pressure side refrigerant flowing toward the compressor from the evaporator;

a fluid path supplying the refrigerant directly from the outlet of the high-pressure side of the internal heat exchanger to the main valve portion of the expansion valve;

wherein the fluid path is connected to a refrigerant path downstream of the main valve portion via the main valve portion;

a bypass extending from the high-pressure upstream side or an intermediate part of the internal heat exchanger;

a temperature sensing portion controlling the main valve portion;

a temperature sensing path supplying the refrigerant from the bypass to the temperature sensing portion; and a refrigerant return path supplying the refrigerant from the temperature sensing portion to the refrigerant path downstream of the main valve portion, wherein the refrigerant return path is a bypass of the main valve portion and connected to the refrigerant path downstream of the main valve portion.

2. The supercritical cycle according to claim 1, wherein the refrigerant return path, the main valve portion and the temperature sensing portion are formed integrally to constitute the expansion valve.

3. The supercritical cycle according to claim 2, wherein the refrigerant return path is formed in the body of the expansion valve.

4. The supercritical cycle according to claim 1, wherein the body of the expansion valve is formed with a through hole passing through the body from the temperature sensing portion to the main valve portion, and wherein a valve rod reaching the main valve portion from the temperature sensing portion is slidably inserted in the through hole, and the valve rod is formed with an orifice reaching the main valve portion from the temperature sensing portion.

5. The supercritical cycle according to claim 1, wherein the bypass is assembled integrally with the internal heat exchanger.

6. The supercritical cycle according to claim 5, wherein the bypass branches from a connector on the high-pressure side of the internal heat exchanger.

7. The supercritical cycle according to claim 5, wherein the upstream end of the bypass and the upstream end of the internal heat exchanger are connected to the radiator by a single coupler, and wherein the downstream end of the bypass and the downstream end of the internal heat exchanger are connected to the temperature sensing path and the expansion valve, respectively, by a single coupler.

8. The supercritical cycle according to claim 1, comprising a mixing portion formed at the intermediate part of the bypass and a mixing path extending to the mixing portion from the intermediate part of a path formed from the intermediate part on the high-pressure side or from the downstream side of the internal heat exchanger to the main valve portion, wherein the mixing portion mixes the refrigerant from the bypass with the refrigerant from the mixing path at an arbitrary ratio and supplies the mixture to the temperature sensing path.

9. The supercritical cycle according to claim 8, wherein the refrigerant from the bypass and the refrigerant from the mixing path are mixed and adjusted by the mixing portion at a ratio in the range of 0 to 100% based on the temperature of at least one of the refrigerant flowing from the bypass into the mixing portion and the refrigerant flowing from the mixing path into the mixing portion.

10. The supercritical cycle according to claim 8, wherein the refrigerant from the bypass and the refrigerant from the mixing path are mixed and adjusted by the mixing portion at a ratio in the range of 0 to 100% based on the pressure of the bypass or the mixing path.

11. The supercritical cycle according to claim 8, wherein the refrigerant from the bypass and the refrigerant from the mixing path are mixed and adjusted in such a manner that the temperature of the refrigerant flowing into the temperature sensing portion may not exceed a predetermined temperature.

12. The supercritical cycle according to claim 8, wherein the mixing portion is formed integrally with the expansion valve or the internal heat exchanger.

13. The supercritical cycle according to claim 1, wherein the internal heat exchanger constitutes a main internal heat exchanger and the bypass constitutes a first bypass, the super critical cycle further comprising:

a second bypass arranged in parallel to the low-pressure side of the main internal heat exchanger and through which the low-pressure side refrigerant flows; and a subsidiary heat exchanger reducing the temperature of the refrigerant flowing into the temperature sensing portion through the first bypass by exchanging heat between the refrigerant flowing in the second bypass and the refrigerant flowing in the first bypass.

14. An expansion valve comprising:

a main valve portion expanding refrigerant flowing from a high to low pressure side of a refrigeration cycle;

a fluid path supplying the refrigerant from an outlet of a high-pressure side of an internal heat exchanger to the main valve portion, wherein the internal heat exchanger exchanges heat between the refrigerant downstream of a radiator and the refrigerant upstream of a compressor in a refrigeration cycle;

wherein the fluid path is connected to a refrigerant path downstream of the main valve portion via the main valve portion;

a temperature sensing portion controlling the main valve portion;

a temperature sensing path introducing the refrigerant into the temperature sensing portion from the high-pressure upstream side or the intermediate part of the internal heat exchanger; and a refrigerant return path supplying the refrigerant from the temperature sensing portion to the refrigerant path downstream of the main valve portion, wherein the refrigerant return path is a bypass of the main valve portion and connected to the refrigerant path downstream of the main valve portion.

15. The expansion valve according to claim 14, wherein the temperature sensing path introduces the refrigerant into the temperature sensing portion directly from the internal heat exchanger.

16. A supercritical cycle comprising:

an evaporator;

a compressor receiving refrigerant from said compressor;

a radiator receiving refrigerant from said compressor;

an expansion valve receiving refrigerant from said radiator, the expansion valve including a main valve portion and a temperature sensing portion controlling an opening of said main valve portion;

an internal heat exchanger exchanging heat between high-pressure side refrigerant flowing toward said expansion valve from the radiator and low-pressure side refrigerant flowing toward the compressor from the evaporator;

a bypass separating said high-pressure side refrigerant flowing toward said expansion valve into a first flow flowing toward said temperature sensing portion and a second flow flowing toward said main valve portion, said second flow being separate from said first flow; and a refrigerant return path supplying refrigerant from the temperature sensing portion to a refrigerant path downstream of said main valve portion, the refrigerant return path bypassing said main valve portion.

* * * * *